United States Patent [19]

Blitz et al.

[11] Patent Number: 4,895,375

[45] Date of Patent: Jan. 23, 1990

[54] BOARD GAME WITH MOVING PIECES

[76] Inventors: Eileen A. Blitz; Harold Blitz, both of 1070 Pebblewood Pl., Gaithersburg, Md. 20878

[21] Appl. No.: 218,138

[22] Filed: Jul. 13, 1988

[51] Int. Cl.[4] ..... A63F 3/02

[52] U.S. Cl. ..... 273/258; 273/291; 273/261

[58] Field of Search ..... 273/258, 261, 249, 291, 273/242, 248; D21/32, 34, 35, 36

[56] References Cited

U.S. PATENT DOCUMENTS

| | | | |
|---|---|---|---|
| 977,485 | 12/1910 | Tercy | 273/258 |
| 1,051,718 | 1/1913 | Elvers | 273/261 |
| 1,196,748 | 8/1916 | Smith | 273/260 |
| 1,692,519 | 11/1928 | Spilling | 273/248 |

FOREIGN PATENT DOCUMENTS

| | | | |
|---|---|---|---|
| 2401247 | 7/1975 | Fed. Rep. of Germany | 273/249 |
| 2133702 | 8/1984 | United Kingdom . | |

*Primary Examiner*—Edward M. Coven
*Assistant Examiner*—Benjamin Layno
*Attorney, Agent, or Firm*—Schwartz & Weinrieb

[57] ABSTRACT

A board game has pieces that are strategically movable along paths around the circumference and along the diameters of several concentric circles. The objectives of the game are to occupy all of the spaces located inside of the innermost of the concentric circles or to prevent the opponent from occupying all of such inner spaces. Pieces may jump over opponents pieces in which case the opponents pieces are removed from the board. Pieces which reach the innermost circle are promoted and may move in any direction or may skip vacant spaces.

11 Claims, 7 Drawing Sheets

BOARD GAME WITH MOVING PIECES

BACKGROUND OF THE INVENTION

This invention relates to board games in which the pieces belonging to competing players may be moved in a variety of ways so as to win the game. When the same players compete over prolonged periods of time, any given game, such as checkers, may become boring to them. So there is a need for new board games with moving pieces that will stimulate renewed interest from board game players because of the novelty of the games. This makes it possible for the players to maintain their interest by switching back and forth among board games having common characteristics.

OBJECTIVES OF THE INVENTION

Accordingly, it is an object of this invention to provide a stimulating board game.

Another object is to provide a board game with pieces that are movable along a variety of paths.

Another object is to provide a moving piece board game that can be won by attaining one of several unrelated goals.

Another object is to provide an improved board game that retains some of the characteristics and moves of checkers.

Another object is to provide a moving piece board game that can be played by two teams of two players.

Another object is to provide a portable, easily understood, stimulating board game that is enjoyable to players having widely varying ages, abilities and backgrounds.

Other objects and advantages of the invention will be apparent from the specification and claims, and the scope of the invention will be set forth in the claims.

DESCRIPTION OF THE INVENTION

Figure 2:
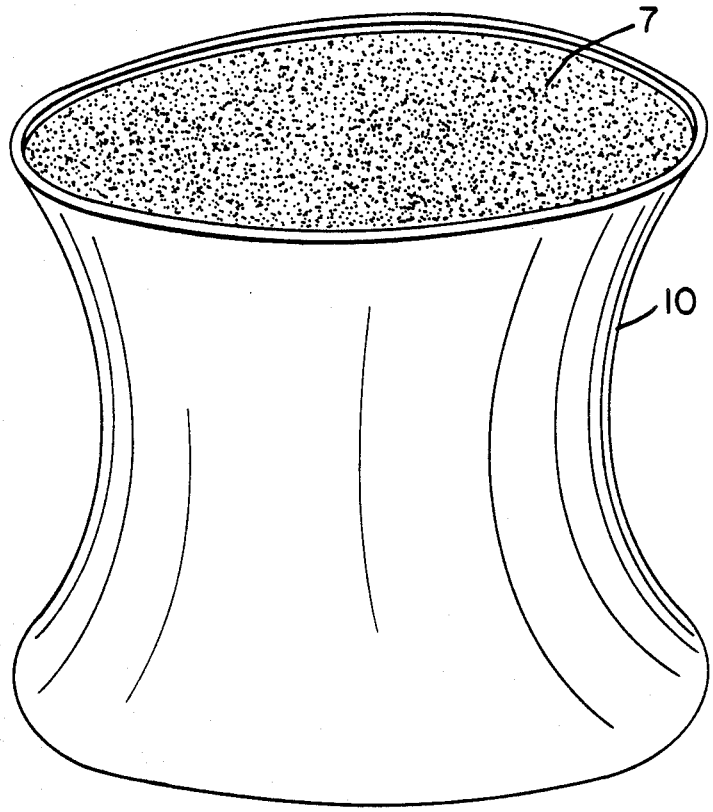
FIG. 2 is an enlarged plan view of one of the movable pieces when unpromoted.

The drawing shows game board 9 having a flat playing surface, upon which movable pieces 10 are placed. Pieces 10 are movable along three series of path lines and can occupy inner and outer spaces as described below. Pieces 10 are two sided and have one side 7 shown in FIG. 2 that is up when the game begins, and another side 8 shown in FIG. 3 that has indicia signifying that the piece has been promoted during the game.

A series of concentric circles 11, 12, 13 and 14 are imprinted or otherwise shown on board 9. The innermost concentric circle 14 contains four movable piece inner position spaces 15 which are aligned along predetermined diameters 16 and 17 of the innermost circle with no space being located at the exact center of the circles. The inner position spaces 15 are connected by line segments 18 and 19 of their respective diameters 16 and 17. The line segments 18 and 19 define a first series of path lines 20 for the movable pieces 10.

All of the movable piece position spaces 22 outside of innermost circle 14 are designated outer positions spaces, and in this embodiment of the game there are fifty-six of such outer position spaces 22. All of the outer position spaces 22 are aligned along line segments 23 which are radial extensions of diameters of innermost circle 14, and the segments 23 obviously are also parts of diameters of the other concentric circles 11, 12 or 13.

A second series of path lines for movable pieces 10 is defined by circumferential line segments 24 that connect adjacent outer position spaces 22 in concentric circumferential path rings 25 around innermost circle 14. All of the adjacent outer position spaces 22 in the same ring 25 are connected to each other by circumferential line segments 24 so as to define an unbroken circumferential path for moving pieces 10 around that ring.

A third series of path lines for movable pieces 10 is defined by the line segments 26, which are radial extensions of diameters of innermost circle 14, and the segments 26 obviously are also parts of the diameters of the other concentric circles 11, 12 or 13. Only a minority of the outer position spaces 22 should be aligned along the diameters 16 and 17 so as to define with their connecting line segments 26 unbroken paths 27 for moving pieces from the outermost concentric circle 11 to inner circle 14. A plurality of the circumferential rings 25 should be located between a pair of the concentric circles, and in this embodiment one pair 29 and 30 of rings 25 is located between circles 12 and 13. Some of the path lines 31 connecting spaces 22 in the rings 29 and 30 are located entirely between circles 12 and 13. There are only four paths on which pieces 10 can be moved into or out of the outermost ring 25 located between circles 11 and 12 because the line segments 26 only connect spaces 22 in the outermost ring 25 to the spaces 22 in the next ring along the diameters 16 and 17.

Figure 1:
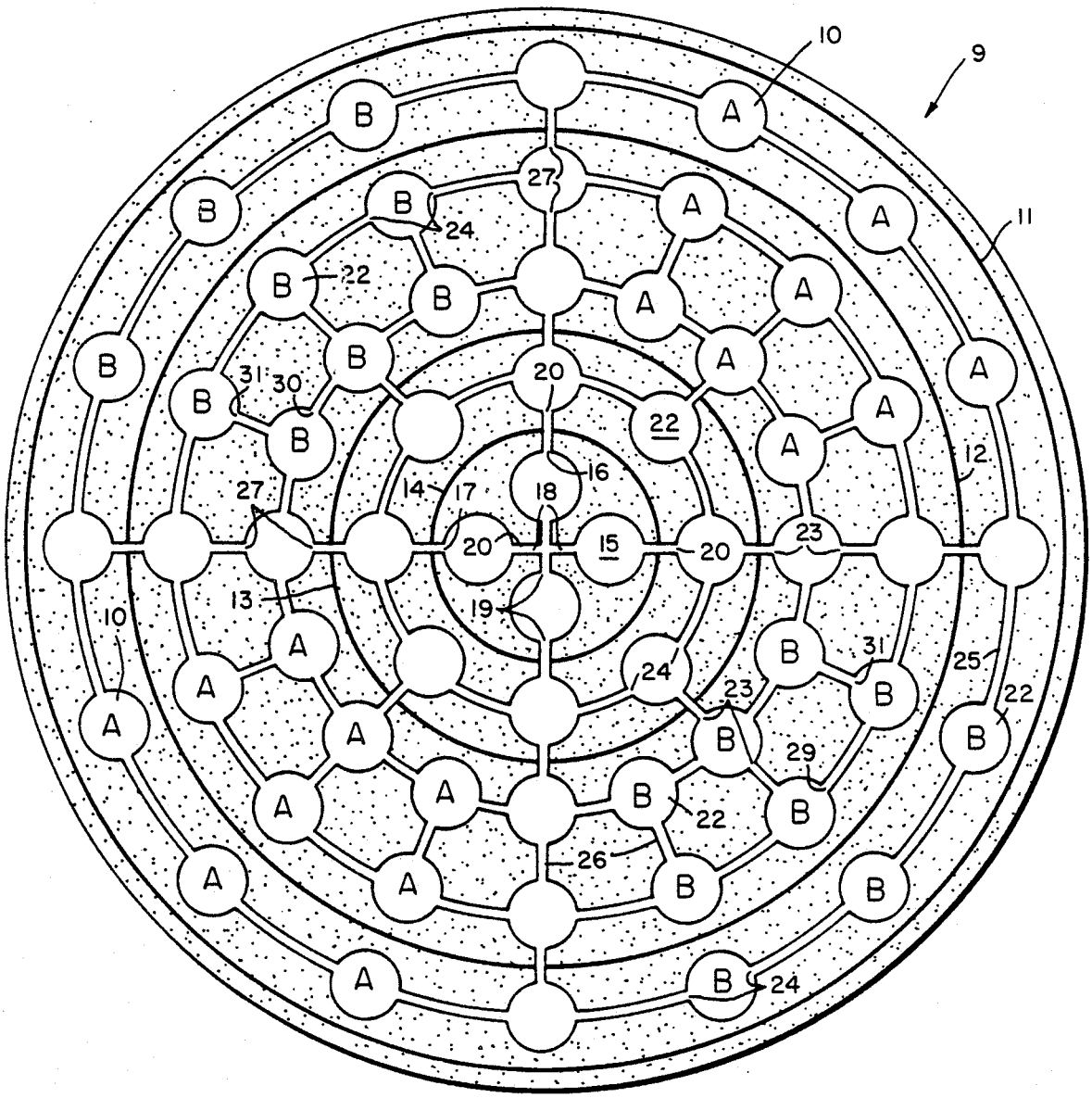
FIG. 1 is a plan view of a game board in accord with this invention showing the starting positions of the movable pieces.
Figure 3:
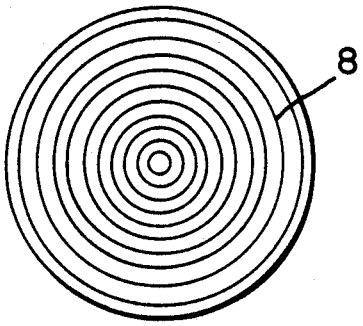
FIG. 3 is an enlarged plan view of the other side of the movable piece of FIG. 2 showing that it has been promoted.
Figure 4:
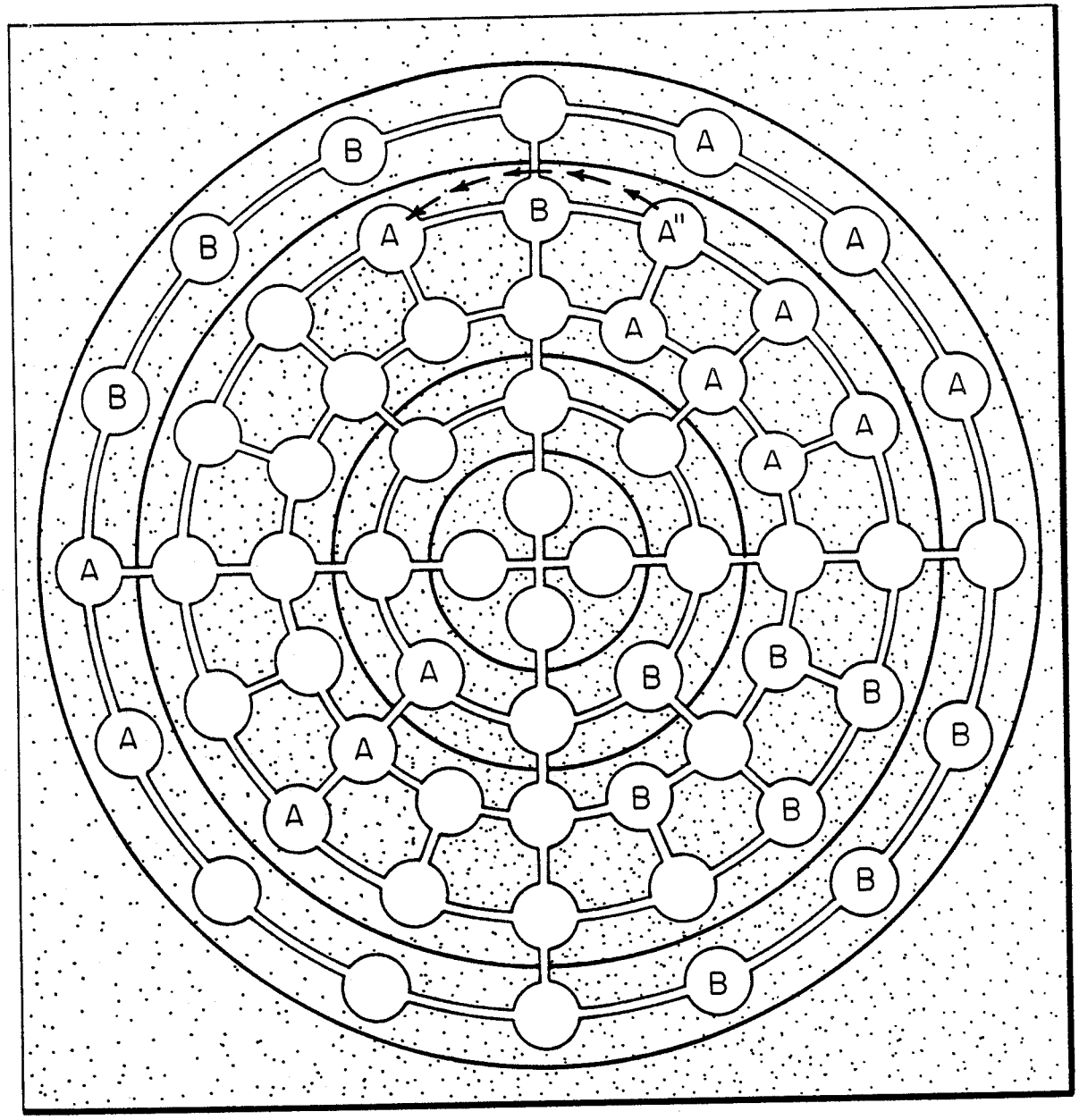
FIG. 4 is a plan view of the board of FIG. 1 on a reduced scale illustrating the principle of jumping.
Figure 5:
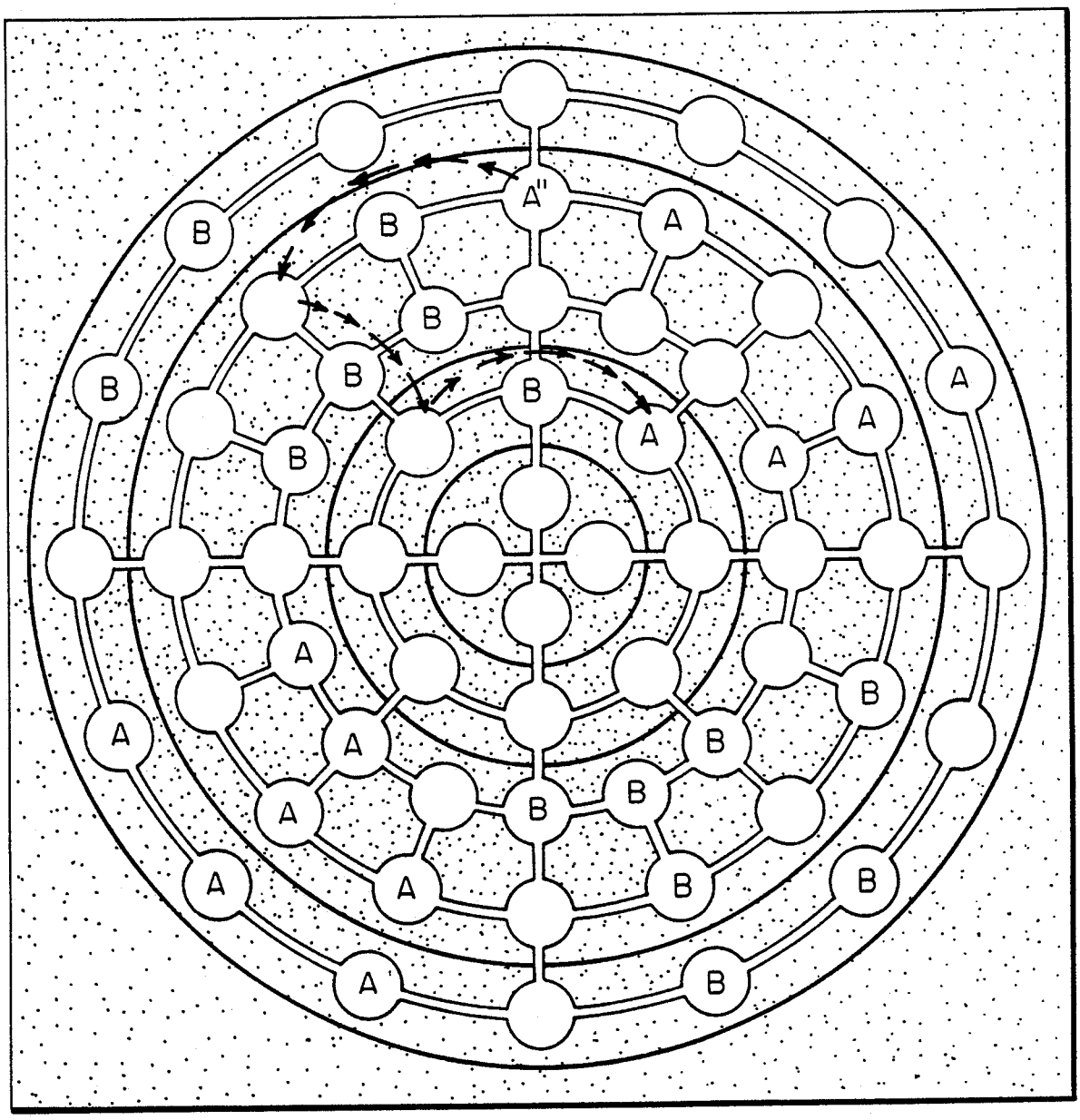
FIG. 5 is a plan view corresponding to FIG. 4 illustrating the principle of multiple jumps.
Figure 6:
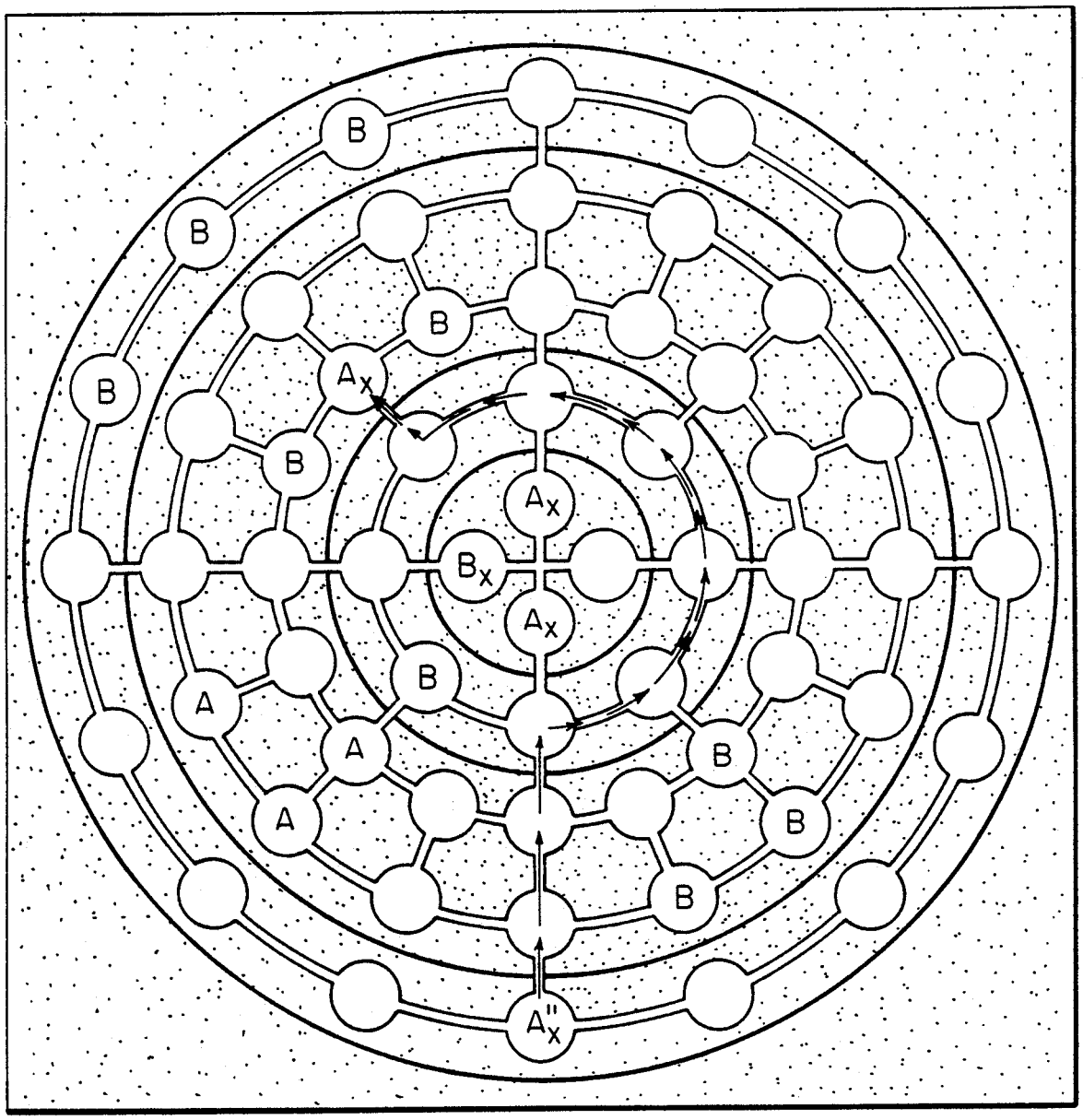
FIGS. 6–8 are plan views corresponding to FIG. 4 illustrating strategic uses of skips.
Figure 7:
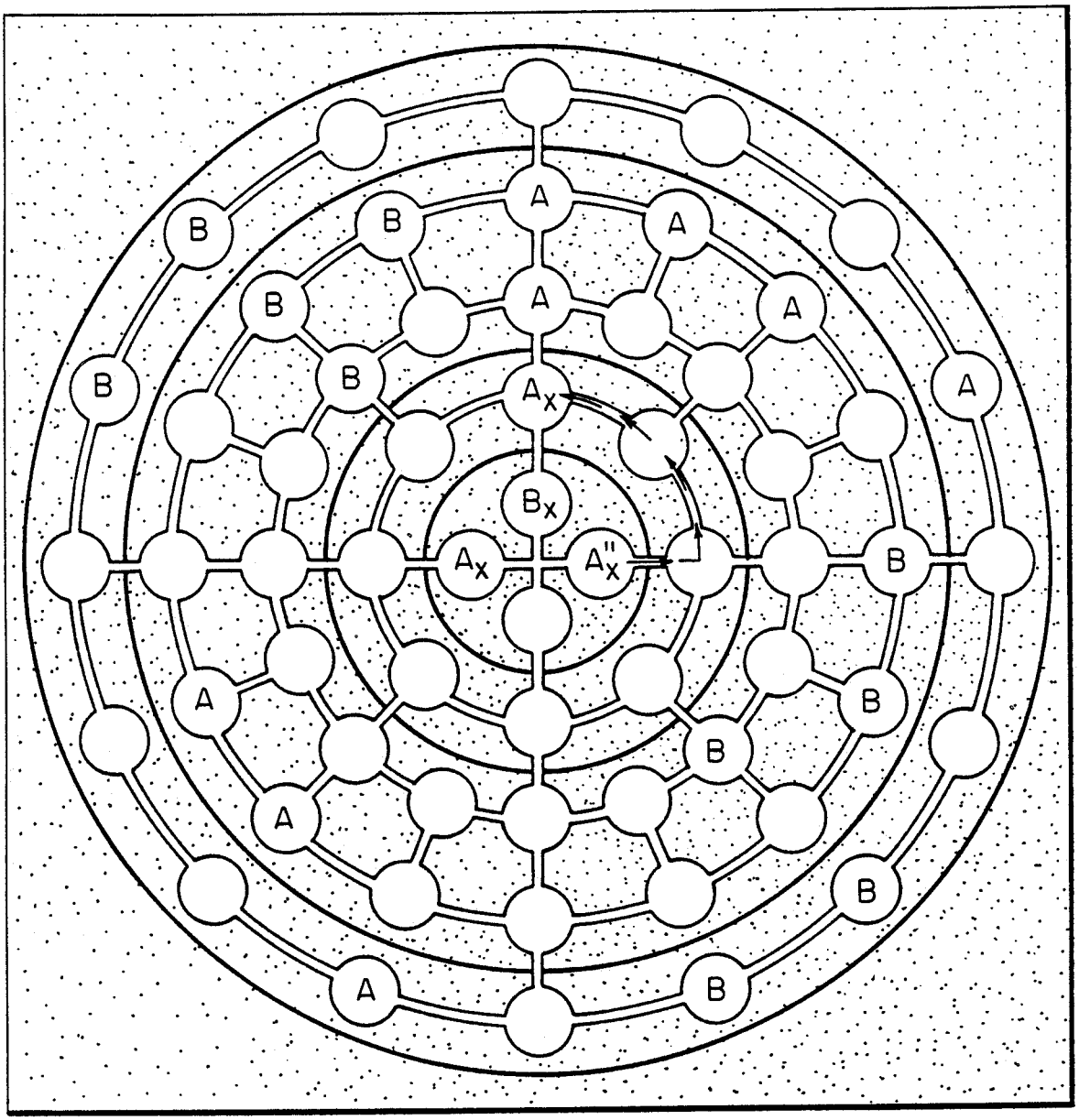
Figure 8:
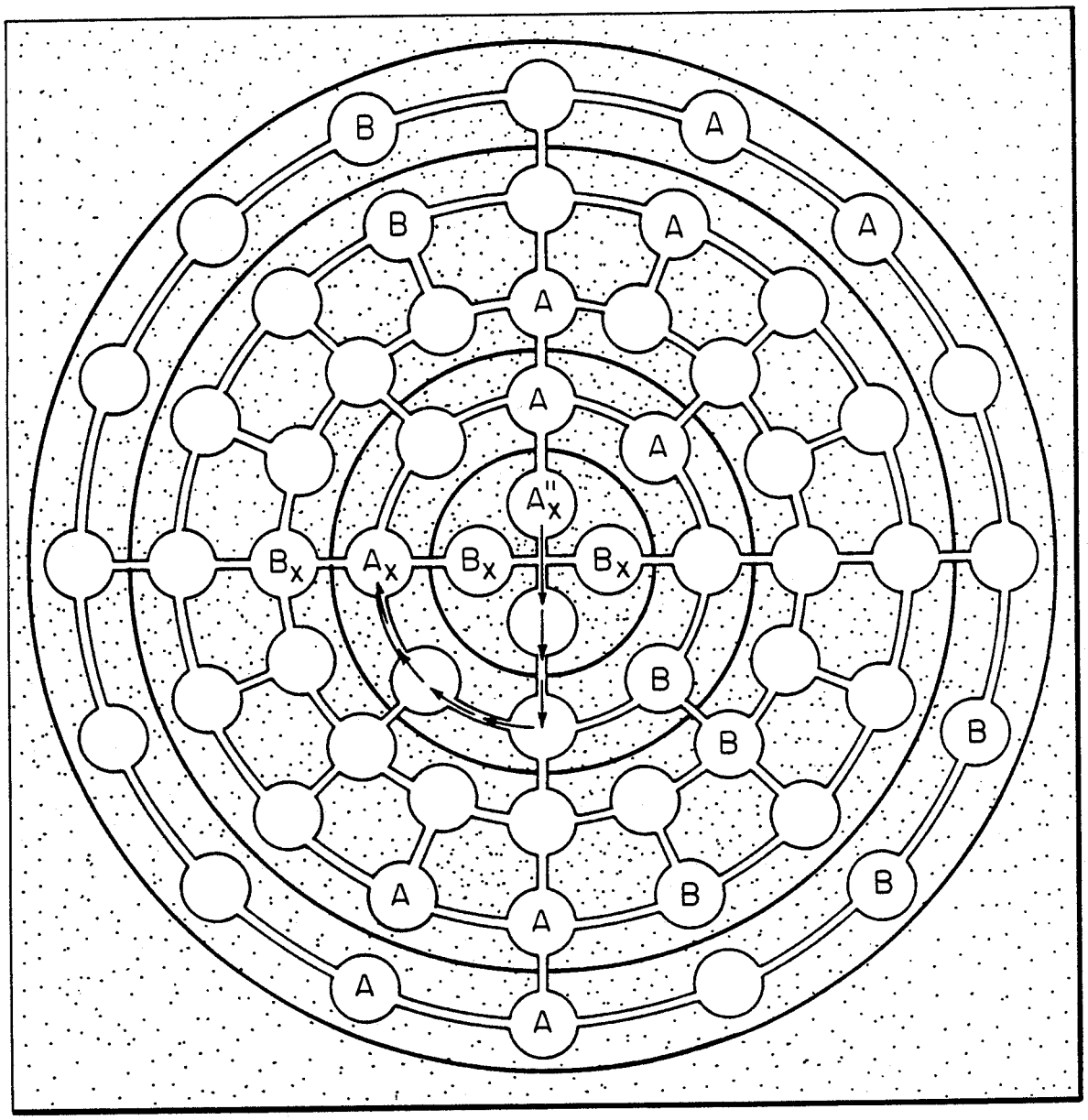

In the embodiment shown in the drawing, the game should be played according to the following rules. To begin, each side has eighteen of the movable pieces 10 which are placed in the outer spaces 22 indicated in FIG. 1 as A to represent one color for one side and B the represent a different color for the other side. The pieces 10 are movable only along the paths in the three series described above. The object of the game is to win by either filling all four of the spaces in innermost circle 14 with one side's pieces 10 or by eliminating all but three or fewer of the other side's pieces so that the other side cannot fill the innermost circle. One side begins by moving a piece 10 and opposing sides alternate turns, which are defined as the completed movement of a single piece 10. Failure to move during a side's turn results in forfeit of the game. Pieces 10 may only move around the rings 25 or toward innermost circle 14, except that a piece 10 located in the ring 25 between circles 13 and 14 may be moved away from the center when beginning a turn. A piece 10 may be moved only one space per turn unless the piece is jumping or unless it has been promoted. Opponents pieces are removed by jumping and any piece 10 can jump any opponent's piece. Jumping is movement of a piece 10 along a path from a space next to an opponent's piece, over the opponent's piece, to an open space on the other side as shown in FIG. 4. Multiple jumps are permitted, including changes in direction as shown in FIG. 5. Every piece 10 that reaches any of the four inner position spaces 15 in innermost circle 14 is permanently promoted, which means a promoted piece may move a single space, or may jump, or may skip, in any direction. Promotion of a piece is signified by turning it over so that the side 8 shown in FIG. 3 is up. Skipping is movement of a promoted piece 3 along a path of more than one space in a single move. Promoted pieces may skip an unlimited number of spaces 15 or 22 in any direction so long as their path is not blocked by any other piece. A piece 10 may not jump during a skip or skip during a jump. FIG. 6 illustrates the use of a skip to trap an opponent. FIG. 7 illustrates the use of a skip to force a move. FIG. 8 illustrates use of a skip to open a space in innermost circle 14. Since there is no space in the exact center of the board, pieces 10 can not change direction in innermost circle 14. Four people can play as two teams of two partners, with their turns proceeding clockwise around board 9. Each partner plays for the team over the entire board without verbal communication of strategies with the other partner.

It has thus been shown that this invention provides a unique movable piece board game having some of the characteristics of checkers, but which has a much greater variety of moves. This can lead to unusual situations that require the players to make decisions that are different and frequently more complicated than those required in conventional checker games. The moves and objects of the game can be easily understood and enjoyed by players of widely varying ages and abilities which should stimulate their renewed interest in this type of game.

While this invention has been described with reference to a particular embodiment, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of this invention.

What is claimed is:

1. A board game upon which a plurality of movable game pieces are to be disposed, comprising:

a game board defining a game playing surface thereon;

a plurality of first position spaces defined within a central region of said game playing surface along two mutually orthogonal lines which intersect each other at a central point of said game playing surface wherein an equal number of spaces are disposed on each orthogonal line within said central region and not disposed on more than one orthogonal line;

a plurality of second position spaces defined radially outwardly of said plurality of first position spaces along radially extending lines;

a first set of movable piece path lines interconnecting a first portion of said second position spaces with each other and with said first position spaces along radial lines which are continuous extensions of said two mutually orthogonal lines;

a second set of movable piece path lines interconnecting a second portion of said second position spaces with each other along radial lines; and a third set of movable piece path lines interconnecting said second set of movable piece path lines with said first set of movable piece path lines along circumferentially extending lines.

2. The board game of claim 1, wherein said movable game pieces are essentially two sided and have indicia on one of their sides for indicating that the pieces have attained promoted status during the game.

3. The board game of claim 1, wherein said central region is defined by an inner circle and said second position spaces being located between a series of circles that are concentric with said inner circle, said inner circle being the innermost of said concentric circles.

4. The board game of claim 3, further comprising said third set of movable piece path lines being defined by line segments of diameters of said concentric circles.

5. The board game of claim 3, wherein some of said second position spaces are aligned along the same diameters of said first position spaces.

6. The board game of claim 5, wherein said second position spaces are aligned along the same diameters of said first position spaces being a minority of the total position spaces.

7. The board game of claim 3, wherein said first position spaces and some of said second position spaces and said movable piece path lines connecting such position spaces define an unbroken path for moving said pieces from the outermost of said concentric circles into said inner circle.

8. The board game of claim 3, further comprising a plurality of circumferential rings of second position spaces being located between a pair of concentric circles, and some of the movable piece path lines in said third set that connect said outer spaces in adjacent rings being located entirely between said pair of concentric circles.

9. The board game of claim 3, wherein the exact center of said concentric circles is unoccupied by any position space.

10. The board game of claim 1, wherein all of said second position spaces in the same concentric ring are connected by said circumferential line segments to define an unbroken circumferential path for said movable pieces around such same ring.

11. The board game of claim 1, wherein four first position spaces are defined within said central region.

* * * * *